US008063835B2

(12) United States Patent
Sjöberg et al.

(10) Patent No.: US 8,063,835 B2
(45) Date of Patent: Nov. 22, 2011

(54) ANTENNA ARRANGEMENT AND A PORTABLE RADIO COMMUNICATION DEVICE FOR SUCH AN ANTENNA ARRANGEMENT

(75) Inventors: Johan Sjöberg, Sollentuna (SE); Jerry Nilsson, Hägersten (SE)

(73) Assignee: Laird Technologies AB, Kista (SE)

( * ) Notice: Subject to any disclaimer, the term of this patent is extended or adjusted under 35 U.S.C. 154(b) by 453 days.

(21) Appl. No.: 12/282,109

(22) PCT Filed: Mar. 5, 2007

(86) PCT No.: PCT/SE2007/000211

§ 371 (c)(1),
(2), (4) Date: Nov. 12, 2008

(87) PCT Pub. No.: WO2007/106012

PCT Pub. Date: Sep. 20, 2007

(65) Prior Publication Data

US 2009/0066591 A1 Mar. 12, 2009

(30) Foreign Application Priority Data

Mar. 13, 2006 (SE) ..... 0600548

(51) Int. Cl.
*H01Q 1/24* (2006.01)
*H01Q 1/38* (2006.01)

(52) U.S. Cl. ..... 343/702; 343/700 MS; 455/575.1; 455/575.7

(58) Field of Classification Search ..... 343/911 R, 343/702, 700 MS; 204/192.22
See application file for complete search history.

(56) References Cited

U.S. PATENT DOCUMENTS

| | | | | |
|---|---|---|---|---|
| 5,245,745 | A * | 9/1993 | Jensen et al. | 29/600 |
| 5,802,699 | A * | 9/1998 | Fjelstad et al. | 29/593 |
| 6,078,259 | A | 6/2000 | Brady et al. | |
| 6,456,499 | B1 * | 9/2002 | Nakajima et al. | 361/752 |
| 6,501,016 | B1 * | 12/2002 | Sosnowski | 174/382 |
| 7,107,016 | B2 * | 9/2006 | Dufosse et al. | 455/90.1 |
| 2004/0075612 | A1 * | 4/2004 | Spiropoulos | 343/702 |
| 2004/0253845 | A1 * | 12/2004 | Brown et al. | 439/66 |
| 2005/0099340 | A1 | 5/2005 | Suzuki | |

(Continued)

FOREIGN PATENT DOCUMENTS

EP 1445823 8/2004

(Continued)

OTHER PUBLICATIONS

International Searching Authority, Written Opinion of International Searching Authority, May 29, 2007.

*Primary Examiner* — Jacob Y Choi
*Assistant Examiner* — Amal Patel
(74) *Attorney, Agent, or Firm* — Harness, Dickey & Pierce, P.L.C.

(57) ABSTRACT

The present invention relates to an antenna arrangement comprising a flexible film (1) having a radiating element (8) mounted to a first side of a dielectric carrier (3). The dielectric carrier (3) has a through hole (5) from the first side thereof to a second side, opposite the first side, thereof. The flexible film (1) is dielectric and comprises a cut linear pattern providing a flip (2) positioned over said through hole (5), wherein said flip (2) is flush with said flexible film (1).

20 Claims, 2 Drawing Sheets

U.S. PATENT DOCUMENTS

| | | | | |
|---|---|---|---|---|
| 2009/0058733 | A1 * | 3/2009 | Kurashima et al. | 343/700 MS |
| 2009/0309796 | A1 * | 12/2009 | Bystrom et al. | 343/702 |

FOREIGN PATENT DOCUMENTS

| | | | |
|---|---|---|---|
| WO | WO 01/24311 | | 4/2001 |
| WO | WO 0133664 | | 5/2001 |
| WO | WO 02/01670 | | 1/2002 |
| WO | WO 0231912 | | 4/2002 |
| WO | WO 02/080304 | | 10/2002 |
| WO | WO 2006016843 | A1 * | 2/2006 |

* cited by examiner

ANTENNA ARRANGEMENT AND A PORTABLE RADIO COMMUNICATION DEVICE FOR SUCH AN ANTENNA ARRANGEMENT

FIELD OF THE INVENTION

The present invention generally relates to antenna arrangements. In particular the present invention relates to an antenna arrangement comprising a flexible film.

BACKGROUND OF THE INVENTION

Antennas for mobile or cellular phones, or other portable radio communication devices, are today often mounted within the chassis of the device it is used for. Since there today is a demand for mobile phones that are small sized there is a limited space for all desired components in a mobile phone, which puts design restrictions on the components in the mobile phone. Antennas are therefore sometimes mounted above other components mounted on a printed wiring board in the mobile phone.

When a component mounted under an antenna needs to be accessed, e.g. for repair or for measurement tests, the antenna needs to be dismounted. It is however not desirable to dismount an antenna, as the remounting of the antenna needs to be very precise or else the antenna characteristics may be changed in a negative way.

SUMMARY OF THE INVENTION

An object of the present invention is to provide an antenna arrangement giving access to components mounted under the antenna arrangement.

Another object of the present invention is to provide a portable radio communication device giving access to components mounted under an antenna arrangement of the portable radio communication device.

These objects, among others, are according to the present invention attained by an antenna arrangement and a portable radio communication device, respectively, as defined in the appended claims.

By providing an antenna arrangement with a flexible film having a radiating element, which flexible film is dielectric and provided with a cut linear pattern over a through hole in a dielectric carrier, it is possible to access a component mounted below the antenna arrangement by pushing a flip formed by the cut linear pattern into the through hole. The flip can thereafter, if desired, be mounted back over the through hole again reforming the antenna arrangement to its original shape. In this way the appearance of the antenna arrangement is very little limited by an access door to the components under the antenna arrangement, at the same time allowing a reliable mounting of the radiating element onto the dielectric carrier. The radiating element is many times very small and thin and handling of it is difficult. By embedding the radiating element into a dielectric film, called a flex film, to support the radiating element its handling and use is facilitated.

Further features and advantages of the present invention will be evident from the following description.

BRIEF DESCRIPTION OF THE DRAWINGS

The present invention will become more fully understood from the detailed description of embodiments given below and the accompanying drawings, which are given by way of illustration only, and thus, are not limitative to the present invention, wherein.

DETAILED DESCRIPTION OF EMBODIMENTS

Figure 1:
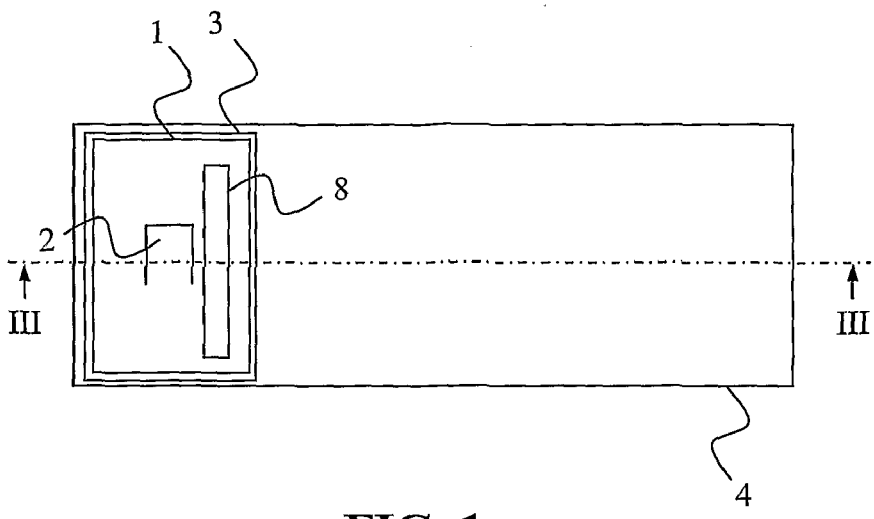
FIG. 1 shows a plan view of an antenna arrangement according to a first embodiment of the present invention.
Figure 2:
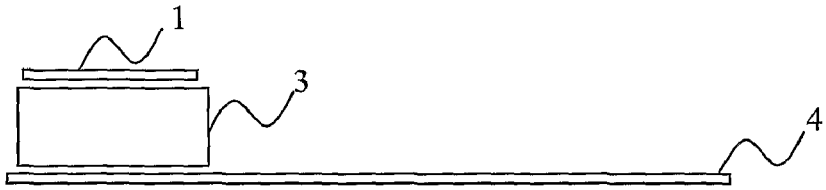
FIG. 2 shows an exploded side view of the antenna arrangement shown in FIG. 1.
Figure 3:
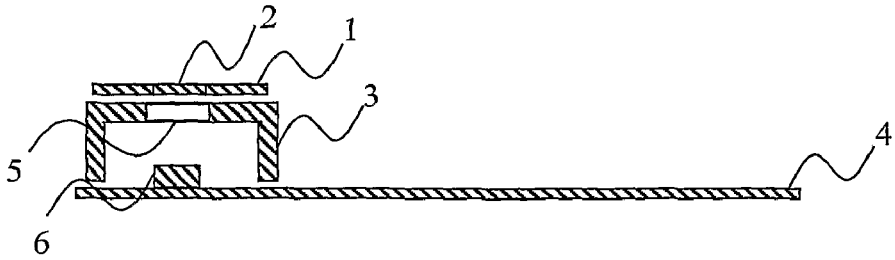
FIG. 3 shows an exploded side view of a cut along the line III-III in FIG. 1 with a flip closed.
Figure 4:
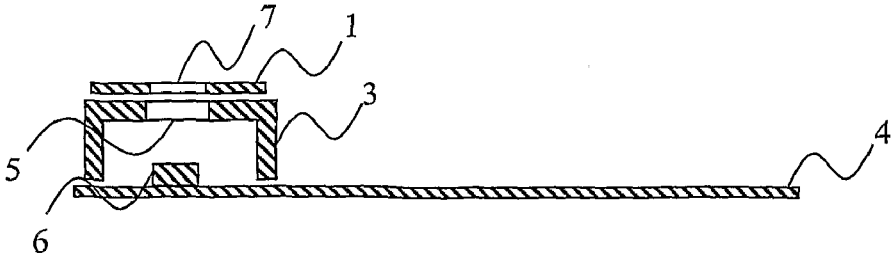
FIG. 4 shows an exploded side view of a cut along the line III-III in FIG. 1 with a flip open.

In the following description, for purpose of explanation and not limitation, specific details are set forth, such as particular techniques and applications in order to provide a thorough understanding of the present invention. However, it will be apparent for a person skilled in the art that the present invention may be practiced in other embodiments that depart from these specific details. In other instances, detailed description of well-known methods and apparatuses are omitted so as not to obscure the description of the present invention with unnecessary details.

A first embodiment of the present invention will now be described with reference to FIGS. 1-4.

An antenna arrangement comprises a flexible film 1 having a radiating element 8 mounted to a dielectric carrier 3. The flexible film 1 is dielectric and support handling and use of the radiating element 8, particularly handling prior and during mounting and use when mounted. The antenna arrangement is in turn mounted on a printed wiring board (PWB) 4 of a portable radio communication device such as a mobile phone or similar.

The PWB 4 has one or more components 6, or access points for e.g. measurement probes, mounted under the antenna arrangement and more precisely under the flexible film 1, i.e. the component 6 and the flexible film 1 occupy the same area of the PWB 4. The dielectric carrier 3 is provided with a through hole 5 substantially above the component 6. The flexible film 1 comprises a flip 2 positioned over the through hole 5, provided by a linear pattern, e.g. cut in a punch action, as it is not desirable to cut out material from the flexible film 1 since removal of such cutout parts are intricate and thus expensive. By a linear pattern the dimension of the cut is intended, whereby the pattern could be curved but still linear.

The flexible film 1, including the flip 2, is preferably attached to the dielectric carrier 3 by an adhesive, but could alternatively be attached by e.g. ultrasonic welding or heat staking. By providing the flexible film 1 with a non-curing adhesive the flip 2 is sturdily kept in position, flush with the flexible film 1, during mounting and use, despite the cut linear pattern, as the adhesive will bleed back over the cut linear pattern providing a supportive surface of the flexible film 1 substantially without any cut.

The through hole 5 is large enough to allow access through the antenna arrangement to the component 6 or access point on the PWB 4, either for removal/mounting of the component 6 or for passing through e.g. a measurement probe. By having the flip 2 somewhat smaller than the through hole 5 the flip 2 can be pushed into the through hole 5, e.g. by a measurement probe, whereby the flip 2 folds into the through hole 5 along a non-cut portion thereof. The flip 2 preferably has the same shape and is only slightly smaller than the outline of the through hole 5 to provide an as large as possible service door to the PWB 4 under the antenna arrangement. Preferably, the through hole 5 comprises a straight portion along which the flip 2 is folded into the through hole 5. By having the cut linear pattern extending slightly outside of the outline of the straight portion of the through hole 5 the flexible film 1 is unlikely to rip open when the flip is folded into the through hole 5 along the straight portion thereof.

The flip 2 and the through hole 5 are preferably rectangular-shaped, or U-shaped, to provide a large service door to the PWB 4 below the antenna arrangement. Preferably the flip 2 is positioned within the outline of the flexible film 1 and outside the outline of the radiating element 8, in order to affect the radiation characteristics of the antenna arrangement as little as possible. The flexible film 1 is preferably significantly larger than the radiating element 8 thereof, particularly when the radiating element 8 is small, since small radiating elements, and thus small flexible films, are intricate to handle e.g. during mounting. If the cut linear pattern is provided across the radiating element 8, or within the radiating element 8, the flip 2 is preferably reattached after its removal, to influence the radiation characteristics of the antenna arrangement as little as possible.

The provided flip 2 can thus be opened by a slight push thereon, revealing the through hole 5 as a service door to the component 6 or the access point under the antenna arrangement.

Figure 5:
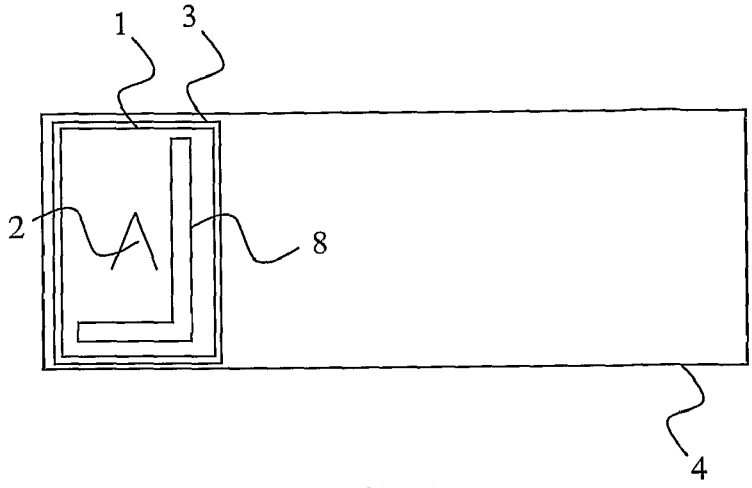
FIG. 5 shows an antenna arrangement according to a second embodiment of the present invention.
Figure 6:
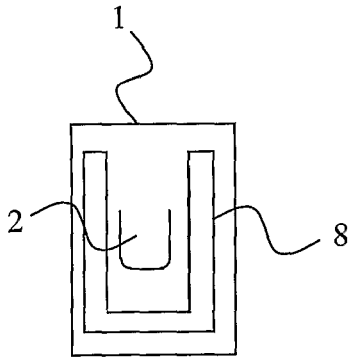
FIGS. 6-9 show different cut patterns according to the present invention.
Figure 7:
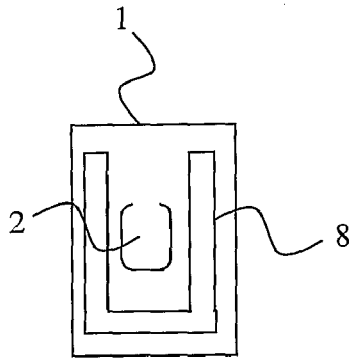
Figure 8:
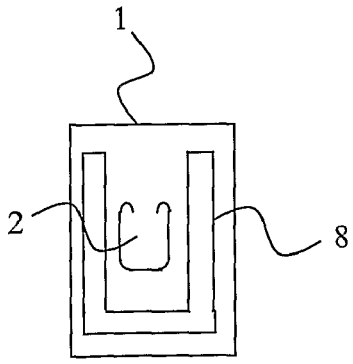
Figure 9:
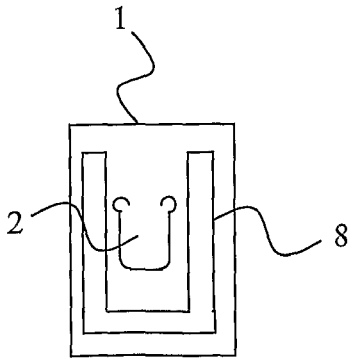

A second embodiment of the present invention will now be described with reference to FIG. 5. This second embodiment of the present invention is identical to the first embodiment described above, apart from that the cut linear pattern, and thus the flip 2, is V-shaped and that the radiating element 8 has a different shape.

Further, the radiating element 8 and the flip 2 can have a shape e.g. as shown in FIGS. 6-9. FIGS. 6-9 also illustrate differently curved end portions of the cut linear pattern to prevent the flip 2 form being ripped open when the flip 2 is folded into the through hole 5 along the straight portion thereof.

It will be obvious that the present invention may be varied in a plurality of ways. Such variations are not to be regarded as departure from the scope of the present invention as defined by the appended claims. The flexible film has e.g. been illustrated as having a rectangular design, but the design of the flexible radiating element is not essential for the present invention and can have any desired shape, generally influenced by the design of the portable radio communication device and of the design of the radiation element. The design of the radiating element has been illustrated with straight portions but can in fact have any desired shape comprising slots, apertures, elongated portions, etc. Further, the shape of the flip can be adapted to fit into a desired design of the flexible film and the radiating element taking the form of a multitude of shapes. Also, more than one flip can be provided for a through hole, more than one flip can be provided for more than one through hole, and a combination of both and/or a plurality of flips. All such variations as would be obvious for a person skilled in the art are intended to be included within the scope of the present invention as defined by the appended claims.

The invention claimed is:

1. An antenna arrangement comprising a flexible film having a radiating element mounted to a first side of a dielectric carrier, said dielectric carrier has a through hole from said first side to a second side opposite said first side, and said flexible film is dielectric and comprises a cut linear pattern providing a flip positioned over said through hole wherein said flip is provided flush with said flexible film and whereby said flip is movable relative to said flexible film to thereby allow said flip to be opened for revealing said through hole and providing access under the antenna arrangement.

2. The antenna arrangement as claimed in claim 1, wherein said flexible film is removably mounted to said dielectric carrier by an adhesive.

3. The antenna arrangement as claimed in claim 2, wherein said adhesive is non-curing.

4. The antenna arrangement as claimed in claim 1, wherein said cut linear pattern is generally U-shaped.

5. The antenna arrangement as claimed in claim 1, wherein said cut linear pattern is substantially inside an outline of said through hole.

6. The antenna arrangement as claimed in claim 1, wherein said cut linear pattern is within an outline of said flexible film.

7. The antenna arrangement as claimed in claim 1, wherein said cut linear pattern is outside an outline of said radiating element.

8. The antenna arrangement as claimed in claim 1, wherein a circumference of said through hole has at least one straight portion.

9. The antenna arrangement as claimed in claim 8, wherein said flip is configured to be folded into said through hole along said straight portion.

10. The antenna arrangement as claimed in claim 1, wherein said flip has a shape substantially similar to the outline of said through hole.

11. The antenna arrangement as claimed in claim 1, wherein said cut linear pattern comprises a curved end portion.

12. A portable radio communication device, comprising a printed wiring board having one or more components and an antenna arrangement as claimed in previous claim 1 mounted on the printed wiring board such that at least one of the one or more components is under the through hole and accessible via the through hole when the flip is opened revealing the through hole.

13. The antenna arrangement as claimed in claim 1, wherein:

the radiating element is embedded into the flexible film; and the flip is an integral portion of the flexible film integrally formed in the flexible film without removing material from the flexible film.

14. The antenna arrangement as claimed in claim 1, wherein the flip is configured to be pushed into the through hole to thereby open the flip and reveal the through hole.

15. An antenna arrangement comprising:

a dielectric carrier having a first side, a second side opposite the first side, and a through hole from the first side to the second side;

a flexible film having a radiating element and an openable/closable portion in the flexible film, the flexible film mounted to the first side of the dielectric carrier such that the openable/closable portion of the flexible film is positioned over the through hole, whereby the openable/closable portion of the flexible film is foldable relative to the flexible film into the through hole to thereby open the openable/closable portion and reveal the through hole providing access to one or more components under the antenna arrangement.

16. The antenna arrangement of claim 15, wherein the openable/closable portion is flush with the flexible film when the openable/closable portion is closed and covering the through hole.

17. The antenna arrangement as claimed in claim 15, wherein:

the radiating element is embedded into the flexible film; and the openable/closeable portion is integrally formed in the flexible film without removing material from the flexible film.

18. A portable radio communication device comprising:

a printed wiring board having one or more components; and the antenna arrangement as claimed in claim 16 mounted on the printed wiring board, such that at least one of the one or more components is under the through hole and accessible when the openable/closable portion of the flexible film is opened thereby revealing the through hole and providing a service door to access the at least one of the one or more components.

19. A method relating to accessing one or more components under an antenna arrangement that includes a flexible film having a radiating element, the flexible film mounted to a dielectric carrier having a through hole from a first side to a second side opposite the first side and positioned above the one or more components, the method comprising moving a portion of the flexible film that is positioned over the through hole to reveal the through hole such that the one or more components are accessible via the through hole.

20. The method of claim 19, wherein the method includes:

integrally forming the portion of the flexible film in the flexible film without removing material from the flexible film; and folding the portion of the flexible film into the through hole along a non-cut portion that connects the folded portion to the flexible film.

* * * * *